US006788004B1

(12) United States Patent
Aoki et al.

(10) Patent No.: US 6,788,004 B1
(45) Date of Patent: Sep. 7, 2004

(54) PLASMA DISPLAY PANEL EXCELLENT IN LUMINOUS CHARACTERISTICS

(75) Inventors: Masaki Aoki, Minoo (JP); Akira Shiokawa, Osaka (JP); Yuusuke Takada, Katano (JP); Ryuichi Murai, Toyonaka (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

(21) Appl. No.: 09/889,754

(22) PCT Filed: Jan. 28, 2000

(86) PCT No.: PCT/JP00/00453

§ 371 (c)(1),
(2), (4) Date: Oct. 12, 2001

(87) PCT Pub. No.: WO00/45412

PCT Pub. Date: Aug. 3, 2000

(30) Foreign Application Priority Data

Jan. 28, 1999 (JP) ..... 11-20701

(51) Int. Cl.[7] ..... H01J 13/12
(52) U.S. Cl. ..... 315/188; 313/493; 314/169.3
(58) Field of Search ..... 315/188, 109.4, 315/169.3, 169.1, 169.2, 169.4; 313/493, 489, 484, 485, 587, 486, 220, 581

(56) References Cited

U.S. PATENT DOCUMENTS 5,086,297 A 2/1992 Miyake et al. ..... 340/759
5,736,815 A 4/1998 Amemiya ..... 313/586
5,742,122 A 4/1998 Amemiya et al. ..... 313/582
5,793,158 A * 8/1998 Wedding, Sr.
5,828,356 A * 10/1998 Stoller
5,977,708 A 11/1999 Amatsu et al. ..... 313/586
6,097,146 A * 8/2000 Yoshimura
6,184,849 B1 * 2/2001 Stoller
6,247,987 B1 * 6/2001 Moore
6,291,943 B1 * 9/2001 Murai et al.
6,452,332 B1 * 9/2002 Moore

FOREIGN PATENT DOCUMENTS

JP 788131 8/1997
JP 10334811 12/1998

* cited by examiner

*Primary Examiner*—Don Wong
*Assistant Examiner*—Chuc Tran

(57) ABSTRACT

The object of the present invention is to greatly improve PDPs in luminance and luminous efficiency, compared to conventional PDPs.

In order to achieve the object, the panel structure is set such that an equivalent field strength of at least 37V/cm·KPa is generated in selected discharge spaces in which the electric charge has been accumulated on their dielectric layer, when a discharge sustaining voltage is applied between a pair of display electrodes.

To achieve such a high equivalent field strength as 37V/cm·KPa, adequate setting of the following factors of the panel structure is effective: a gap between a pair of display electrodes, a thickness and a permittivity of a dielectric layer, and an amount of Xe filled in discharge spaces.

30 Claims, 5 Drawing Sheets

PLASMA DISPLAY PANEL EXCELLENT IN LUMINOUS CHARACTERISTICS

FIELD OF INVENTION

The present invention relates to plasma display panels used for such apparatuses as color display devices for televisions.

BACKGROUND ART

In recent years of increasing needs for high quality, large screen televisions such as high-definition televisions, products such as a CRT, a liquid-crystal display (hereinafter referred to as a LCD), or a plasma display panel (hereinafter referred to as a PDP) are being developed to meet needs in various fields.

CRTs, popular conventional displays for televisions, have advantages in resolution, and image quality. They are, however, not ideal for screens of 40 inches or more, since they are destined to enlarge their depth and weight when the screens become large. LCDs, on the other hand, have advantages in that they consume little electricity and their driving voltage is low. However, they have technical problems for creating large screens.

PDPs, on the contrary, make it possible to create large screens with small depth. Indeed, PDP products with 50-inch diagonal screen, have been already commercialized.

PDPs can broadly be divided into direct current types (DC types) and alternating current types (AC types). These days, AC types have become mainstream, since they fit the need for upsizing screens.

A conventional AC type PDP that displays color by RGB is provided with a front cover plate and a back plate placed in a parallel direction to each other, but without contact. The inner surface of the front cover plate is provided with pairs of display electrodes placed in a stripe pattern, which is covered with a dielectric layer made of lead glass. On the inner surface of the back plate, address electrodes in a stripe pattern are placed in a direction at right angles to the display electrodes, and ribs are placed between each strip of address electrodes. Each gap developed between stripes of ribs, is provided with red, green, and blue ultraviolet-excited phosphor layers. In each discharge space surrounded by the front cover plate, the back plate, and the ribs, a discharge gas is filled.

Either a mixture of Helium (He) and xenon (Xe), or a mixture of Neon (Ne) and Xe is commonly used as a discharge gas. Pressure at which the discharge gas is filled is within the range of 100–500 Torr (which is approximately 10–70 KPa), for a discharge of 250 V or less (Please consult with M. Nobrio, T. Yoshioka, Y. Sano, K. Nunomura, SID94' Digest 727–730, 1994 for details).

The light emitting principle of PDPs is basically the same as that of fluorescent lamps; it is required to apply voltage to the display electrodes to emit a normal glow discharge first, thereby making Xe emit an ultraviolet light (i.e. a xenon resonance line with a wavelength of 147 nm). This ultraviolet light, in turn, excites phosphors to emit light. However, due to the inefficiency in both the conversion rate from discharge energy to ultraviolet light and from phosphors to visible light, it is difficult for PDPs to obtain as high luminance as fluorescent lamps.

Relating to the above point, Applied Physics Vol. 51, No. 3, 1982, pp. 344–347 specifically describes that for PDPs with gas compositions of He—Xe, or Ne—Xe, the percentage of the supplied electric energy converted to ultraviolet light is about 2%, and it states further that only 0.2% of the electric energy is converted to visible light. (Also consult with Optical Technology Contact Vol. 34, No. 1, 1996, pp.25; FLAT PANEL DISPLAY 1996, Part5-3; and NHK Technology Research Vol. 31, No. 1, 1979, pp. 18)

Under such circumstances of PDPs, a technology for achieving higher luminance than the current standards is desired.

Specifically, PDPs widely used today for 40–42 inch class televisions have panel efficiency of about 1.2 1 m/w and screen luminance of 400 cd/m$^2$ for NTSC picture element level (i.e. 640*480 pixels, cell pitch of 0.43 mm*1.29 mm, and cell size of 0.55 mm$^2$) (consult with FLAT-PANEL DISPLAY 1997 Part 5-1 PP.198 for a detailed description). It is desired, however, to improve the stated current standards for the panel efficiency and the screen luminance to 3–5 1 m/w and 500 cd/m$^2$, which are CRTs' average.

Just as the demand for the improved luminance, an improved resolution level has also been an important issue in the field of PDP displays. It is possible to improve a resolution level for PDPs by shortening a pitch of the ribs and by reducing the distance between electrodes. Generally in PDPs however, the finer the resolution level, the less luminance due to the resulting smaller light emitting area. Thus, it is desirable to improve the luminous efficiency for the enhancement in luminance and to lessen the discharge voltage, as a resolution level becomes higher.

Concretely, full-spec high-definition televisions of 42 inch class, which are receiving attention these days, have 1920*1125 pixels and cell pitch of 0.15 mm*0.48 mm. In such televisions, the cell size is 0.072 mm$^2$, which is 1/7 to 1/8 that of NTSC televisions. As already mentioned, the smaller the cell size is, the amount of light emission is destined to be smaller. Therefore, if PDPs for high-definition televisions of a 42-inch diagonal screen are to be made with conventional cell structures, the luminous efficiency and the luminance are expected to be reduced to about 0.15–0.17 1 m/w and 50–60 cd/m$^2$, respectively.

For such PDPs to achieve the same luminance level as CRTs conforming to the NTSC standard, which is about 500 cd/m$^2$, it is required to increase luminous efficiency by 10 times or more (i.e. 5 1 m/w or more)(consult with FLAT-PANEL DISPLAY 1997 Part 5-1, pp. 200 for details).

DISCLOSURE OF INVENTION

The object of the present invention is to greatly improve PDPs in luminance and luminous efficiency, compared to conventional alternating current type surface-discharge PDPs.

To achieve the object, the dielectric layer is made by laminating at least two different dielectric materials, and the panel structure is set such that an electric field with an equivalent field strength of at least 37V/cm·KPa is generated in a discharge space, when a discharge sustaining voltage is applied between pairs of display electrodes in order to selectively glow-discharge in discharge spaces in which the electric charge has been accumulated on the dielectric layer.

Note that, in this alternating current type surface-discharge PDP, field strength differs from area to area in a discharge space. What is meant here is that at least 37V/cm·KPa must be satisfied in the area of the largest field strength in a discharge space.

Here, the discharge sustaining voltage is one of those kinds that discharge only in discharge spaces accumulated with stored charge and not elsewhere. That is, it is lower voltage than discharge starting voltage which discharge in every type of discharge space.

PDPs with the above panel structures realize much enhanced panel luminance and luminous efficiency than conventional PDPs, since these panel structures enable to emit at least 37V/cm·Kpa of equivalent field strength which is much stronger than conventional PDPs.

The occurrence of this much strong electric field generates high energy electrons and a xenon excimer (molecular beam) with a wavelength of 173 nm in the discharge field, whereas conventional PDPs generate ultraviolet light mainly consisting of a xenon resonance line of 147 nm wavelength. The xenon molecular beam has phosphors toward ultraviolet light than the xenon resonance line.

The following are the factors that affect the strength of the electric field in the discharge space: an amount of xenon filled in the discharge space; a thickness and a permittivity of the dielectric layers; and a distance between a pair of display electrodes. Adequate adjustment of these factors is the key for the realization of high equivalent field strength as at least 37V/cm·KPa. Concretely, each of these factors should be adjusted as follows and that all these conditions should be combined to produce effect.

As for the amount of xenon contained in the discharge space, it should be maintained 5% or more of the total discharge gas. The enclosing pressure of the xenon should be bigger than that for conventional PDPs; specifically the desirable range is between 66.5 KPa and 200 KPa.

The thickness of the dielectric layers should be kept within the range of 3–35 $\mu$m, which is thinner than conventional ones. The dielectric layers mentioned here are those formed on the opposing surfaces of pairs of display electrodes against each other.

It is true that the thinner the dielectric layers, the more the resultant effect is expected. In reality, however, it is desirable to keep them 10 $\mu$m or more, taking into consideration the withstand voltage.

The permittivity of the dielectric layers should be set in the range of 6–11, to have a desirable result, which is smaller than conventional permittivity which is around 11–13. The permittivity, however, should be kept in the range of 6–9, for the display electrodes comprising such metal electrodes as Ag or Cr—Cu—Cr.

This is due to the fact that as the permittivity of the dielectric layers become low, the smaller the electric capacity of the panel is, when the PDPs are assumed to be condensers. Roughly speaking, electric consumption in the driving circuit is indirectly proportional to the electric capacity of the panel. Therefore, the lower the electric capacity, the lower the electric consumption in the driving circuit.

Especially in the above case where the dielectric layers are kept thin as 35 $\mu$m or less, the electric capacity of the panel tends to be larger. Thus, keeping the permittivity small (i.e. in the range of 6–11) is important in order to maintain the electric capacity of the panel small enough.

In order to fulfill the low permittivity, having two or more dielectric layers is an effective solution. For these multiple layers, it is easy to set permittivity of the dielectric layers depending on the thickness or the materials for each layer. Therefore it becomes easier than one layer to arrange the permittivity to be around 6–11 or 6–9 as desired.

As for the distance between pairs of electrodes, it is desirable to keep it in the range of 20–90 $\mu$m where they face the discharge space.

It is also effective to have forms of a pair of display electrodes asymmetric to each other, or to have protrusions on at least one piece of a pair of display electrodes. The mentioned methods will increase emission of ultraviolet light by strengthening the electric field, by which the luminance and the luminous efficiency will be accordingly enhanced.

BEST MODE FOR CARRYING OUT THE INVENTION

Figure 1:
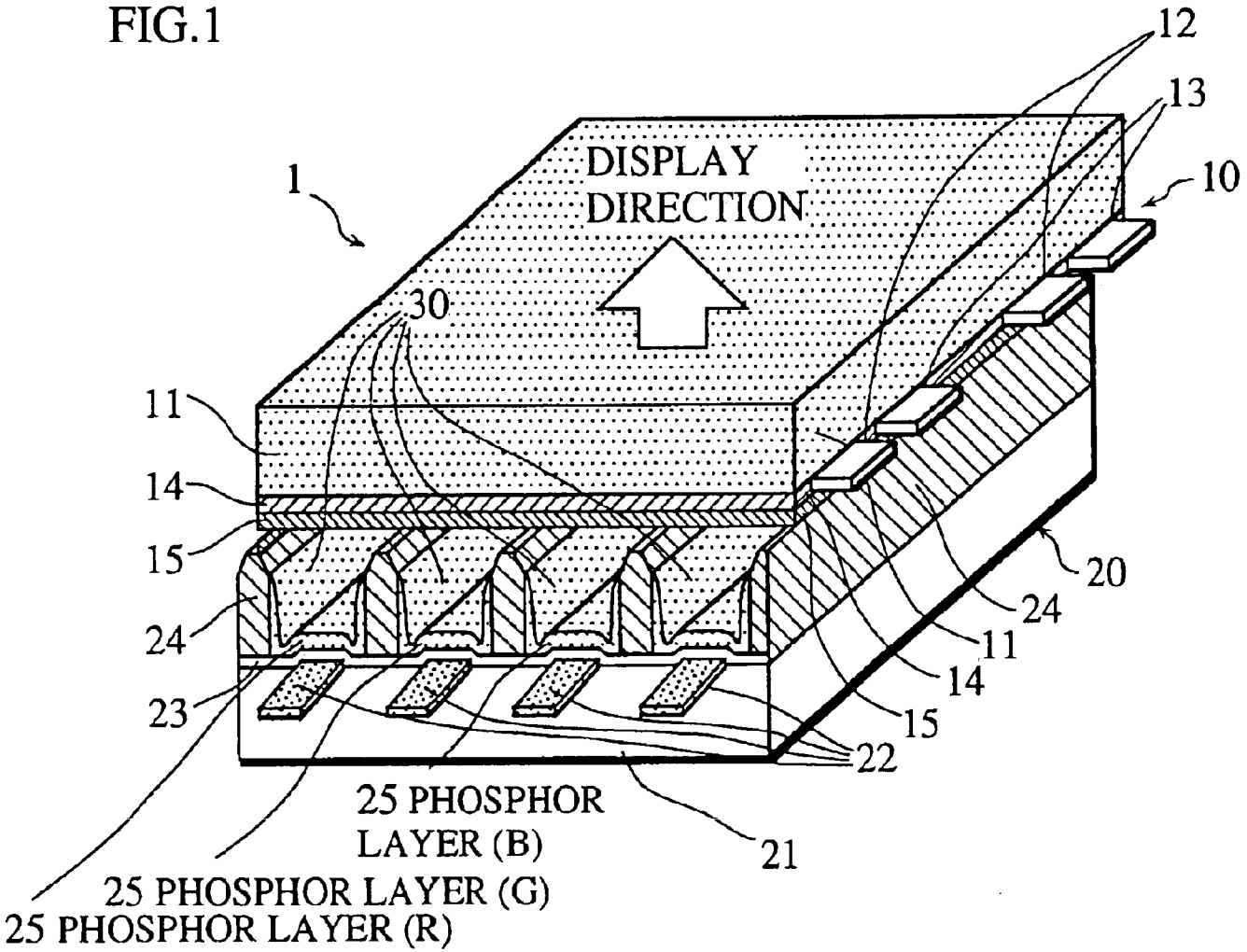
FIG. 1 is a perspective view showing main components of an AC discharge type PDP.

FIG. 1 is a perspective view showing part of an AC discharge type PDP 1; specifically it illustrates part of display area situated in the center of the PDP1.

The PDP1 comprises a front panel 10 and a back panel 20. The front panel 10 is provided with display electrode 12 for scanning purpose, and display electrode 13 for a sustaining purpose (hereinafter interchangeably referred to as scanning electrodes 12, and sustaining electrode 13 respectively), a dielectric layer 14, a protective layer 15 on a front glass substrate 11. The back panel 20 is provided with address electrodes 22 and a dielectric layer 23 on a back glass substrate 21. The front panel 10 and the back panel 20 are placed in parallel direction, without contact, to each other in such a manner that the display electrode 12, and 13 on the front panel 10 are opposing to the address electrode 22 on the back panel 20. Between the front panel 10 and the back panel 20, ribs 24 are placed in such a way that they form discharge space 30 between the two panels, and the discharge space 30 is filled with discharge gas.

On the inner surface of the back panel 20, inside the discharge space 30, phosphor layers 25 in a stripe pattern are provided. Each stripe of the phosphor layers 25 has either red, green, or blue phosphor, and that in this order repeatedly.

The display electrodes 12 and 13, and the address electrodes 22 are both in a stripe pattern. The display electrodes 12 and 13 are placed in right angles to the ribs 24, and the address electrodes 22 in parallel to the ribs 24. Discharge cells are formed in the intersection of the scanning electrodes 12 and the address electrodes 22. The PDP 1 is structured to emit light from each discharge cell by the color of the phosphor layer in which the cell is placed. As seen above, the PDP 1 is a panel structure with discharge cells of three colored phosphors in the order of red, green, blue colors repeatedly, arranged in matrices patterns.

The address electrodes 22 are made of metal electrodes (e.g. silver or Cr—Cu—Cr), with a thickness of 5 $\mu$m for example. For PDPs for high definition televisions of 40 inch class, the interval between adjacent address electrodes 22 is to be set around 0.2 mm or less.

The display electrodes 12 and 13 may comprise wide transparent electrodes 12*a* and 13*a* (e.g. with a thickness of 150 $\mu$m), made of electrically conducting metal oxides such as ITO, $SnO_2$, or ZnO, on which narrow bus electrodes 12*b* and 13*b* also made of metal such as silver or Cr—Cu—Cr are stacked (e.g. with a thickness of 30 $\mu$m). Or, they may comprise only metal electrodes just as the address electrodes 22.

Generally, it might be desirable to have stacked display electrodes in order to maintain low resistance in electrodes, and to realize spacious discharge capacity inside discharge cells. However, uniform display electrodes made of only metal electrodes have advantages in that they reduce the electrical capacity of the panel, which facilitates the production of the panel. Therefore it is desirable to adopt uniform display electrodes especially for finer panel structures.

The dielectric layer 14 is made of dielectric materials and covers the inner surface of the front glass substrate 11 where the display electrodes 12 are provided. Specifically the dielectric layer 14 may either made of low-melting metal of PbO, or ZnO. Or it may be made of a combination of these.

The protective layer 15 is a thin layer made of magnesium oxide (MgO), which covers the whole inner surface of dielectric layer 14.

The dielectric layer 23 is a thin layer made of the same as the dielectric layer 14, except the dielectric layer 23 also includes $TiO_2$ particles. Due to this, the dielectric layer 23 also serves as "visible light reflection layer" which promotes effective reflection of emitted visible light against the front panel 10. Usually the weight percentage of $TiO_2$ to the dielectric glass is 10–30%.

The ribs 24 are made of glass material, which protrude from the inner surface of the dielectric layer 23 of the back panel 20 against the front panel. The height of the ribs 24 is 100 $\mu$m for instance.

Examples of phosphor materials making the phosphor layers 25 are as follows:

Blue phosphors: $BaMgAl_{10}O_{17}:Eu^{2+}$ or $BaMgAl_{14}O_{23}:Eu^{2+}$

Green phosphors: $Zn_2SiO_4:Mn$

Red phosphors: $(Y_xGd_{1-x})BO_3:Eu^{3+}$

Figure 2:
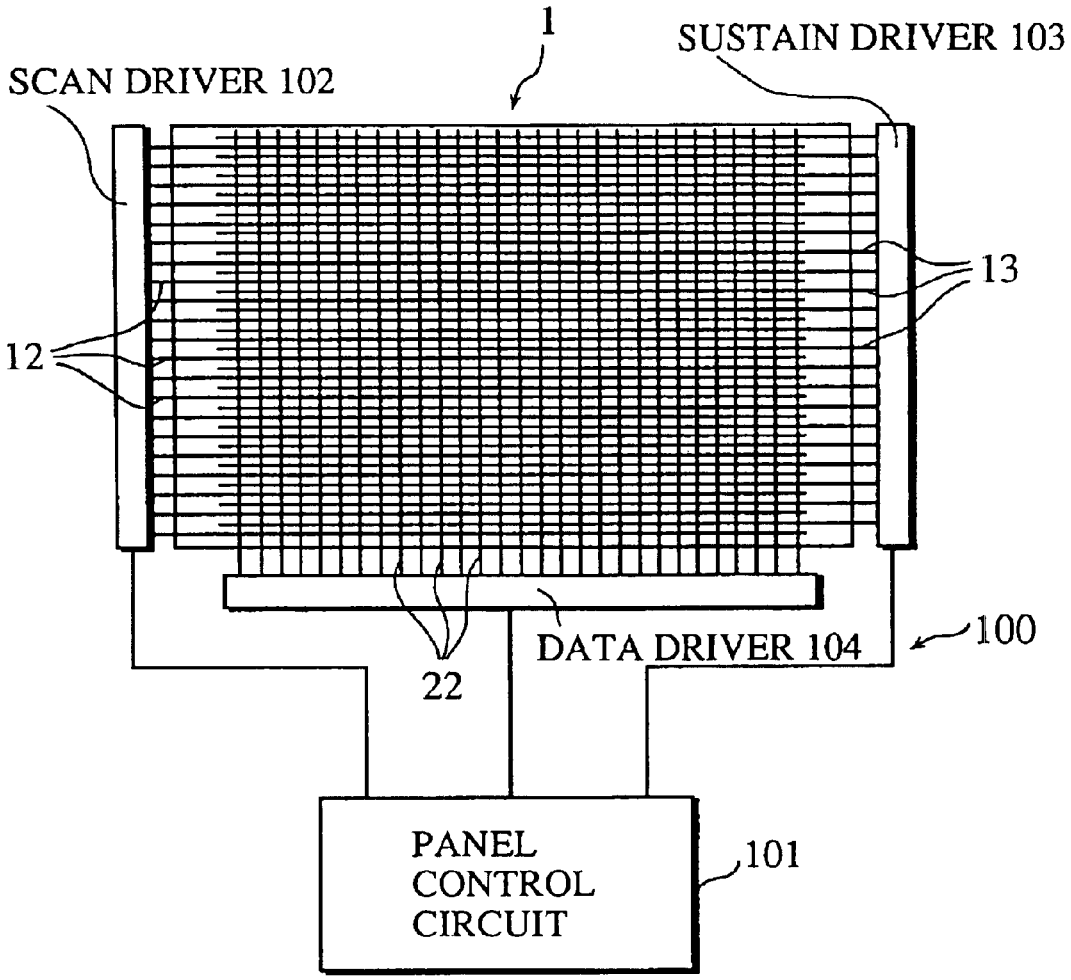
FIG. 2 illustrates a structure of a PDP display unit, which is the PDP shown in FIG. 1 connected with a driving circuit 100.

FIG. 2 illustrates a structure of a PDP display unit, which is the PDP1 connected with a driving circuit 100.

As shown in this figure, a scan driver 102 is connected to the scanning electrodes 12, a sustain driver 103 to the sustaining electrode 13, and a data driver 104 to the address electrodes 22. Finally the drivers 102 through 104 are connected to a panel control circuit 101. Voltage is applied in accordance with the instruction of the panel control circuit 101 from each driver 102–104 to electrodes 12, 13, 22, as will be explained later.

The PDP1 uses a field timesharing gradation display method as a driving method, which time-divides one frame (i.e. 1 television field) into sub-frames (sub-fields), in order to represent halftones by combinations of sub-fields.

For example, since a picture image by a NTSC method composed of sixty fields per second, time per 1 television field is set to 16.7 ms. Generally, 1 television field is composed of 8 sub-fields, and ratios of illuminating time are set to 1, 2, 4, 8, 16, 32, 64, 128, for each sub-field. Illuminating time of each discharge cell for 1 television field is controlled by 256 tones by the combination of light-on/off in each sub-field. That is, it represents accumulated tones of the illuminating time of each sub-field.

Figure 3:
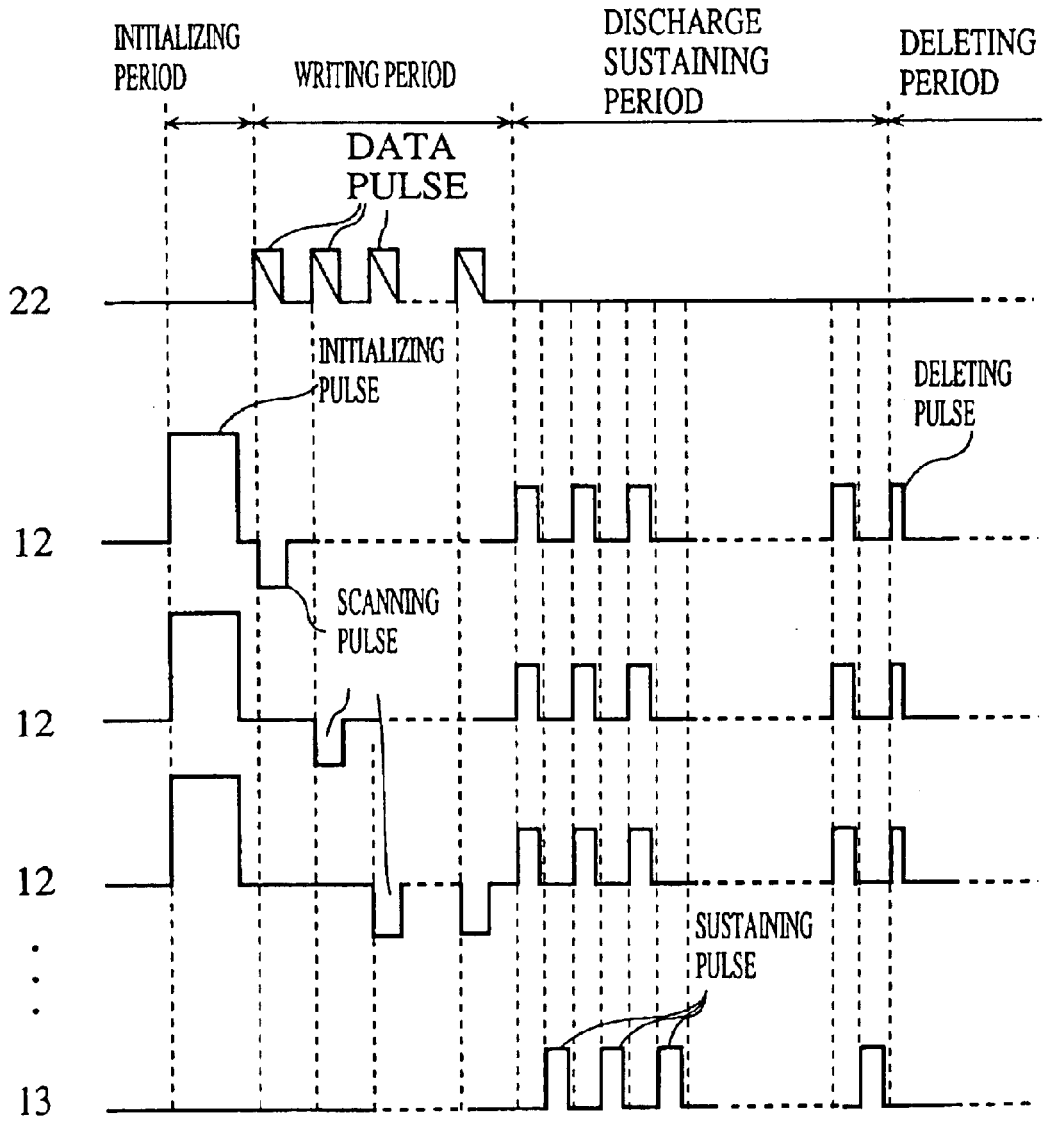
FIG. 3 is a chart showing an example of timing for applying pulses to each electrode, when driving the PDP.

FIG. 3 is a chart showing an example of timing for applying pulses to each electrode in one sub-field. The driving circuit 100 performs a series of operations, described as follows, for one sub-field in order to drive the PDP1.

In the initializing period, an initializing pulse is applied to every stripe of the scanning electrodes 12 to initialize every discharge cell.

In an address period, applying a scanning pulse sequentially to the scanning electrodes 12, the driving circuit applies data pulses to electrodes selected from the address electrodes 22, in order to accumulate stored charge in the dielectric layer 14 of discharge cells to be illuminated. By the above procedure, the driving circuit performs writing of picture element information for one screen.

In a discharge sustaining period, an AC voltage pulse is applied to every pair of display electrodes 12 and 13 at a time, for a predetermined period of time.

Thus arranged, in cells that are selected to discharge, the illumination continues for a predetermined period of time. In cells that are not selected to discharge, there is no illumination for the period. This selective discharge of cells realizes the display of image.

At the end of the discharge sustaining period, a thin stripe of deleting pulse is applied to every stripe of the scanning electrodes 12 at a time to delete stored charge in each cell.

The voltage applied to every pair of the display electrodes 12 and 13 in the discharge sustaining period (hereinafter referred to as "normal sustaining voltage") is set such that it makes cells with stored charge to discharge since the potential on the surface of the dielectric layer exceeds the discharge starting voltage. For cells without stored charge, on the other hand, it is set not to discharge.

In other words, the normal sustaining voltage depends on sizes of discharge cells, a distance between a pair of the display electrodes, or a thickness of a dielectric layer determined by a panel structure of a PDP. Conventionally this normal sustaining voltage is below a discharge starting voltage of a discharge cell (i.e. within the range of <discharge starting voltage −50V> to <discharge starting voltage>).

If the voltage applied between display electrodes is higher than the above range, illumination occurs in unselected discharge spaces. If lower, on the contrary, illumination does not occur even in selected discharge spaces.

The mentioned discharge starting voltage is measured from observation of a PDP by eyes while the voltage applied between the display electrodes is gradually increased. Applied voltage when one or predetermined number of discharge cells (e.g. 3 cells) started to illuminate is recorded as discharge starting voltage in this measuring method.

Panel Feature for Generating Strong Electric Field in Discharge Spaces

Figure 4:
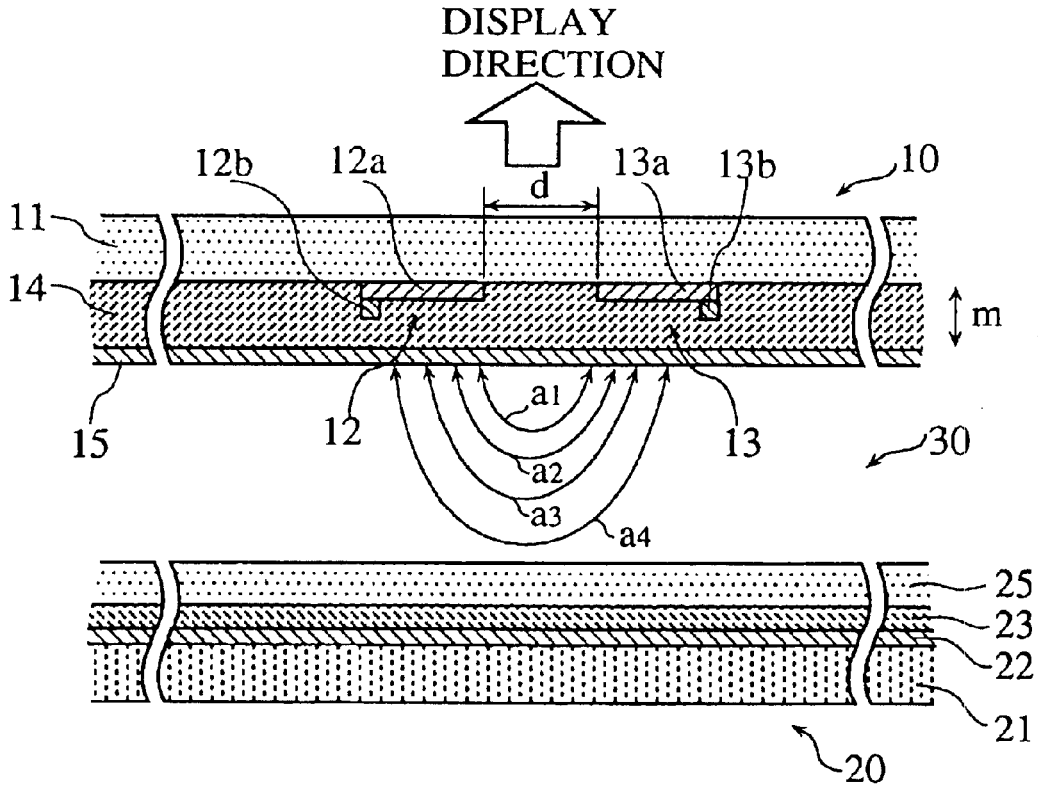
FIG. 4 is a sectional view of main components of the PDP depicted in FIG. 1.

FIG. 4 shows a cross-sectional view of main part of the PDP depicted in FIG. 1.

The PDP1 in this embodiment, the panel is structured to generate strong equivalent electric field of 37V/cm·KPa or more in discharge space 30, when applied the "normal sustaining voltage" between the display electrodes 12 and 13.

Elements that determine the strength of electric field includes such as a distance between the display electrodes 12 and 13, the dielectric layer 14, and an amount of Xe filled in the discharge space 30.

For generating strong electric field, it is necessary to increase a ratio of Xe to an entire discharge gas, to decrease the distance "d" between the display electrodes, to decrease the thickness "m" of the dielectric layer, and to select dielectric material with a low permittivity.

From the above point, the PDP1 in this best mode sets no the elements as follows.

Regarding the composition of the discharge gas, the PDP1 is arranged to use either one of Ne—Xe, He—Ne—Xe, Ne—Xe—Ar gas mixtures that the conventional PDP uses, and an amount of Xe contained in the discharge gas is set in the range of 5% or more and 90% or less.

The pressure at which the discharge gas is filled in the PDP1 is set in the range of 66.5 to 200 KPa, while conventional PDPs are set in the range from around 10 to 70 KPa.

The thickness of the dielectric layer 14 is set to 35 $\mu$m or below, which is thinner than 40 $\mu$m that conventional PDPs use.

The thickness of the dielectric layer 14 here means a thickness on the tip of both of the display electrodes 12 and 13 facing each other (i.e. if the display electrodes 12 and 13 are stacked electrodes, then it is the thickness on the tip of the transparent electrodes 12*a* and 13*a*).

It is more effective to have a smaller thickness, preferably 25 μm or less. However, taking the withstand voltage into account, it is required to have a thickness of 3 μm or more. On metal electrodes that make both the display electrodes 12 and 13, it is desirable to have a thickness of 10 μm or more. That is, it is ideal to set a thickness to 10 μm or more on the display electrode 12 and 13 as a whole, for a uniform electrodes only made of metal. And for stacked electrodes such as depicted in FIG. 4, it is desirable to set a thickness to 10 μm or more on the bus electrodes.

A permittivity of the dielectric layer is kept low as 6 or more and less than 11, while a normal range is from 11 to 13 for many conventional PDPs.

Especially if a thickness for the dielectric layer 14 is to be kept small as 35 μm or below, an electrical capacity of a panel tends to increase. Therefore, in order to control the panel electrical capacity to be small, it is preferable to keep a permittivity small (i.e. in the range of 6–11).

The permittivity here means a permittivity of the dielectric layer 14 above the display electrodes 12 and 13.

An average distance between the display electrodes is around 100 μm for conventional PDPs. In the PDP1, however, it is set to be smaller such as 20–90 μm.

The form of each of the electrode 12 and 13 for the PDP1 is normally a uniform band form, rendering the uniform gap between the display electrodes accordingly. However as will be shown in FIG. 7, there are display electrodes whose form of gap in between is not uniform.

For such a case, what is important as a distance is where the display electrodes contacts the discharge space through the dielectric layer 14 (i e. where actual discharge takes place), and not where they are overlapping with the ribs 24. Therefore, the mentioned distance should be set to 20–90 μm.

To have strong equivalent electric field as 37V/cm·KPa or more in the discharge space 30, it is preferable to set all the following elements as above; a composition of the discharge gas and pressure at which the gas is filled, a thickness and a permittivity of the dielectric layer 14, a distance between the display electrodes 12 and 13.

Sometimes, however, it is not necessary to satisfy all the elements above. For example, if forms of the display electrodes are arranged as depicted in the following FIG. 7, it is possible to obtain an equivalent electric field of 37V/cm·KPa or more without satisfying all these conditions.

Thus structured, the PDP1 generates an equivalent electric field of 37V/cm·KPa or more inside the discharge space 30 when the driving circuit 100 applies the normal sustaining voltage between the display electrodes 12 and 13, thereby realizing an enhanced panel luminance and luminous efficiency compared to conventional PDPs.

As for the upper limit of the equivalent electric, field strength, the maximum actually recorded was 300V/cm·KPa as described in Table 1 of the embodiment, which probably requires no further specifications.

The Strength of the Electric Field in the Discharge Space, and the Relation Between the Panel Luminance and Luminous Efficiency The reason why higher luminance and luminous efficiency are obtained by the occurrence of strong electric field (high equivalent electric field) in the discharge space in the sustaining discharge period, is as follows.

For conventional PDPs, an electric field that emerges in the discharge space, when discharging, is around 30V/cm·KPa or lower. In such a case, ultraviolet light that emerges in the discharge space is mainly made of Xe resonance line. The Xe resonance line has low exciting efficiency (i.e. low radiant efficiency) of phosphors. On the contrary, the occurrence of 37V/cm·Kpa or more electric field when discharging generates much amount of Xe excimer (molecular beam) in such a way that a ratio of Xe excimer exceeds that of Xe resonance line in the ultraviolet light.

Note that the Xe excimer has high exciting efficiency (radiant efficiency) of the phosphor layers 25, compared to Xe resonance line.

That is, self-absorbance inherent in the Xe resonance line makes it difficult to radiate the line on a phosphor layer. In addition, a short wavelength inherent in the Xe resonance line whose average is around 147 nm renders a very low constant for converting the line into visible light by means of a phosphor layer.

For detained description on the fact that the strong electric field helps generate much excimer, a literature by the Electricity Society (Study group of Discharge, by Mr. Akinori Oda et al, ED-96-221, Oct. 1, 1996 says that high energy and high Xe ratio is required for generation of excimer. Also Ushio Technology Information, Lightedge, No. 11, October 1997 edition, pp. 12–13 reveals that strong electricity field and high gas pressure are two conditions that help generate excimer.

'O plus E' No. 195, 1996 February, pp.99–100 states that an excited spectrum for each RGB on a phosphor tends to increase for the wavelength range of about 140–200 nm as a wavelength increases.

Since the PDP1 sets a permittivity of the dielectric layer 14 to be in the range of 6 or more and less than 11, the electric capacity of the panel is relatively kept low. Accordingly, electricity consumed by the driving circuit 100 for driving the PDP1 is kept low, which also helps enhance the luminous efficiency of the PDP1 (consult with Transactions A by the Institute of Electrical Engineers of Japan, Vol. 118, No. 15, 1998 pp. 537–542).

The low permittivity of the dielectric layer 14 helps decrease electricity consumption in the driving circuit 100, not only in the discharge period but also in the address discharge period, which also contributes to the enhancement of the luminous efficiency.

Detailed Description on Equivalent Electric Field Strength and a Permittivity Equivalent electric field strength can be represented as E/p, when electric field strength is Vs and a pressure from discharge gas is p, as a laid-open literature (Discharge Handbook, Section 3, Chap. 2, pp. 128–129) explains.

This equivalent electric field strength can be derived from the following expression. In this expression, note that discharge voltage is Vs and a distance between a pair of electrodes is d; the equivalent electric field strength is derived from Vs and a product of p and d.

$$E/p\ (V/\text{cm}\cdot\text{KPa}) = Vs/(pd) \qquad \text{expression 1}$$

It is known that Paschen law holds for the relation between Vs and a pd product, and that on a Paschen curve au showing the relation between the pd product and the discharge voltage Vs, there exists so-called "Paschen minimum", which is a pd product that correlates with the minimum Vs value.

Basically, the equivalent electric field strength generated in the discharge space 30 of the PDP1 can be calculated using the relation represented in the expression 1.

"Strong equivalent electric field as 37V/cm·Kpa or more" described earlier as one of the requirements, should be satisfied in the area whose electric field is strongest in the discharge space 30, and not necessarily in the whole discharge space 30. The following is a detailed description of this point with reference to FIG. 4.

FIG. 4 shows how electric lines of force a1, a2, a3, a4 are generated inside the discharge space 30 by applying voltage between the discharge electrodes 12 and 13. Here, a density of the electric lines of force represents electric field strength.

Generally, when discharging, a density varies from area to area in a discharge space.

In the discharge space depicted in FIG. 4, an inner side of the discharge space (in the vicinity of a1) has higher density, while an outer side (in the vicinity of a4) has lower density. That is, the electric field is higher for the inner side and lower for the outer side.

It should be noted that if 37V/cm·KPa or more equivalent electric field strength is satisfied in the inner side whose electric field is the strongest in the discharge space, it is possible to realize enhanced panel luminance and luminous efficiency compared to conventional PDPs; in other words, it can be less than 37V/cm·Kpa for the outer side.

A permittivity of the dielectric layer 14 in the PDP1 can be measured using LCR meter (such as Hewlett-Packard 4284A).

A concrete measuring method is as follows. First, several adjacent pairs of the display electrodes 12 and 13 on the front panel 10 are combined to make "a common electrode." Second, An Ag electrode is formed on the dielectric layer 14 in such a manner that it covers the common electrode. Then a capacitance C of the dielectric layer is measured by applying AC voltage between the Ag electrode and the common electrode. The capacitance C is directly displayed in the LCR meter.

A permittivity $\epsilon$ of the dielectric layer 14 is calculated using the following expression as follows, substituting the observed value C.

$$C=\epsilon S/m \qquad \text{expression 2,}$$

Where S is a size of the common electrode and m is a thickness of the dielectric layer 14.

Effect of the PDP1

In the PDP1, enhanced panel luminance and luminous efficiency are achieved by generating 37V/cm·Kpa or more equivalent electric field strength in the sustaining discharge phase. This much strength of the equivalent electric field is generated by setting the following elements as stated in the former section; a composition of the discharge gas and pressure at which the gas is filled, a thickness and a permittivity of the dielectric layer 14, and a distance between the display electrodes 12 and 13.

As for a discharge starting voltage, it is kept low in the range of about 150–190 V, which enables the driving circuit 100 to realize the same driving voltage as conventional PDPs or even lower. This helps keep electricity consumption low.

As will be explained in the embodiment, panel luminance for a conventional PDP is about 400 cd/m$^2$ (Consult with "FLAT-PANEL DISPLAY" 1997, pp.198 for details). On the contrary, the PDP1 realizes the panel luminance of about 800–1650 cd/m$^2$, which is approximately 2 to 3 times as much panel luminance as conventional PDPs, or even more.

Form of the Dielectric Layer 14

The dielectric layer 14 can be formed as a single layer as depicted in FIG. 4. However, a multiple layer structure is also possible by laminating different dielectric materials together.

The multiple layer structure makes it easier to set a permittivity for the whole dielectric layer 14, since it enables an adjustment of a ratio of a thickness for each layer, and a selection of dielectric material for each layer, as will be explained in the following section in details.

The multiple layer structure can take two forms; one form covers the whole of display electrodes 12 and 13 as a layer structure evenly (even multiple layer structure), and the other form covers only some parts of the display electrodes as a layer structure (uneven multiple layer structure).

Figure 5:
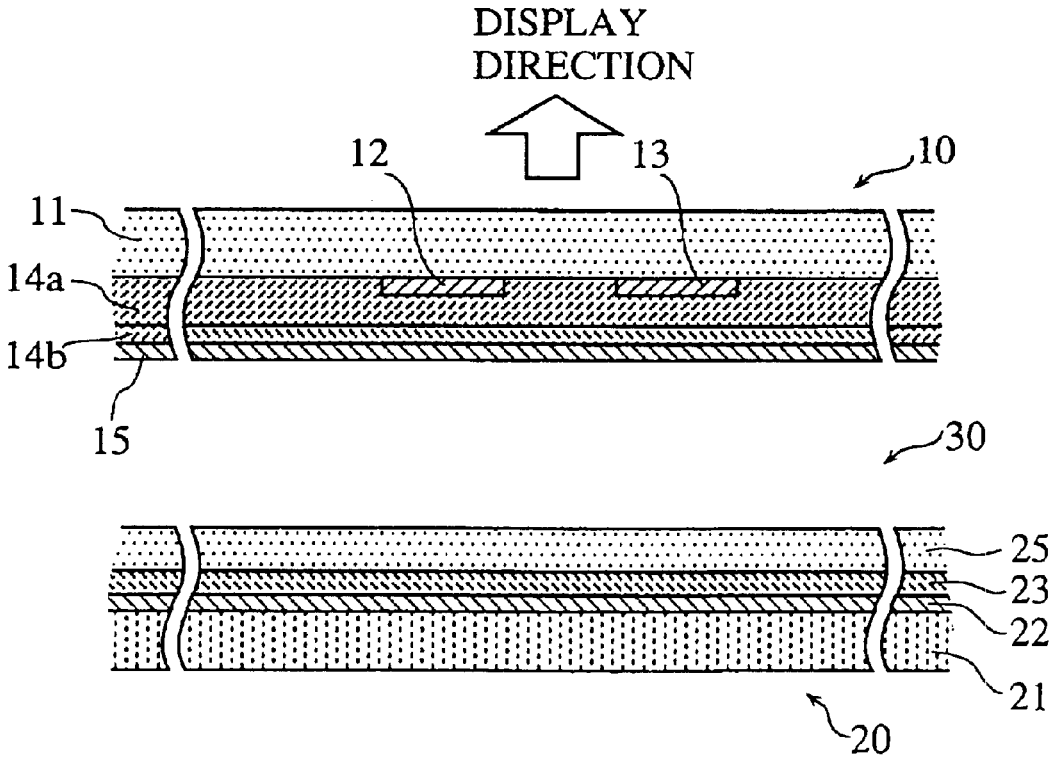
FIG. 5 shows an example of display electrodes made of metal electrodes in the PDP.

In FIG. 5, the display electrodes 12 and 13 are made of metal electrodes. In this example, the dielectric layer 14 is made of a first dielectric layer 14*a* and a second dielectric layer 14*b*, both covering the whole surface of the front glass substrate 11 evenly. As this example shows, it is preferable to have an even multiple layer structure for the metal display electrodes.

For stacked display electrodes, it is possible to have an even multiple layer structure as stated above. However, it is also possible to have uneven multiple layer structure as follows.

A Variant Form of the Dielectric 14—Uneven Multiple Layer Structure

Figure 6:
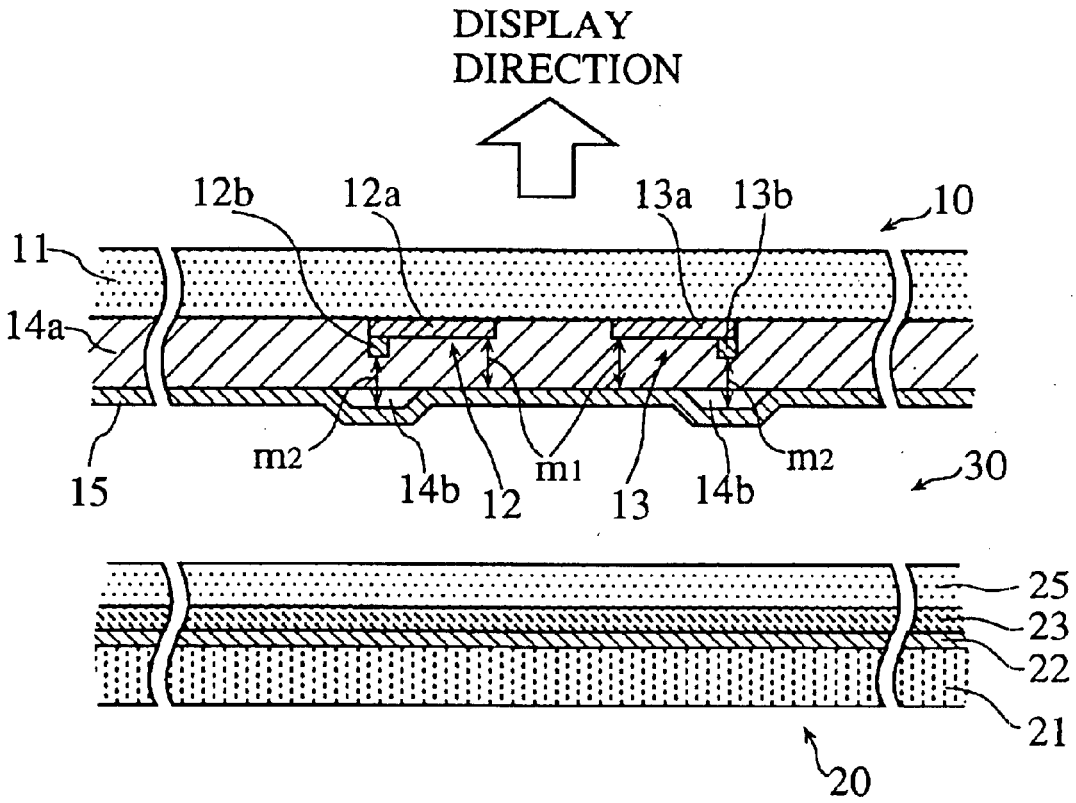
FIG. 6 shows an example in which a second dielectric layer is formed only on the area where the bus electrodes are provided in the PDP.

Display electrodes 12 and 13 in FIG. 6 are stacked display electrodes, comprising transparent electrodes 12*a*and 13*a*, on each of which bus electrodes 12*b* and 13*b* are stacked respectively. Dielectric layers comprise of two kinds; a first dielectric layer 14*a* that covers the whole inner surface of the front glass substrate 11, and a second dielectric layer 14*b* that covers only where the bus electrodes 12*b* and 13*b* are provided. A thickness of each layer is 3–5 $\mu$m for the first dielectric layer 14*a*, and 15–25 $\mu$m for the second dielectric layer 14*b*, for example.

An uneven multiple dielectric layer structure, constructed as above, enables greater thickness of the dielectric layers where there are bus electrodes 12*b* and 13*b* underneath, than where there are only the transparent electrodes 12*a* and 13*a* underneath. That is, m2 in FIG. 6 is greater than m1.

The uneven multiple dielectric layer structure enables to have the following effect.

Usually, the PDP1 with stacked display electrodes 12 and 13 that are provided with the bus electrodes 12*b* and 13*b* on the transparent electrodes 12*a* and 13*a* is susceptible to electrical breakdowns during an address discharge between the scanning electrodes 12 and the address electrodes 22. Note that the main place where discharge occurs is between the bus electrode 12*b* and the address electrode 22. Since the bus electrode 12*b* protrudes from the transparent electrode 12*a*, when the dielectric layer on the bus electrodes 12*b* is thin, the chance of electrical breakdown is great.

In FIG. 6, on the contrary, the PDP1 can have greater chances of avoiding electrical breakdowns, since address discharge is arranged to take place where the first dielectric layer 14*a* and the second dielectric layer 14*b*are overlapping each other (with a thickness m2), which facilitates a writing process.

When performing sustaining discharge between the scanning electrodes 12 and the sustaining electrode 13, the PDP1 discharges mainly between the transparent electrodes 12*a* and 13*a*. This discharge is performed where there is only the first dielectric layer 14*a* (with a thickness of m1). To summarize, in the sustaining discharge process, discharge takes place mainly in the thinner dielectric layer. This enables stronger electric field inside discharge cells, which results in higher luminance.

Form of the Display Electrodes

Figure 7:
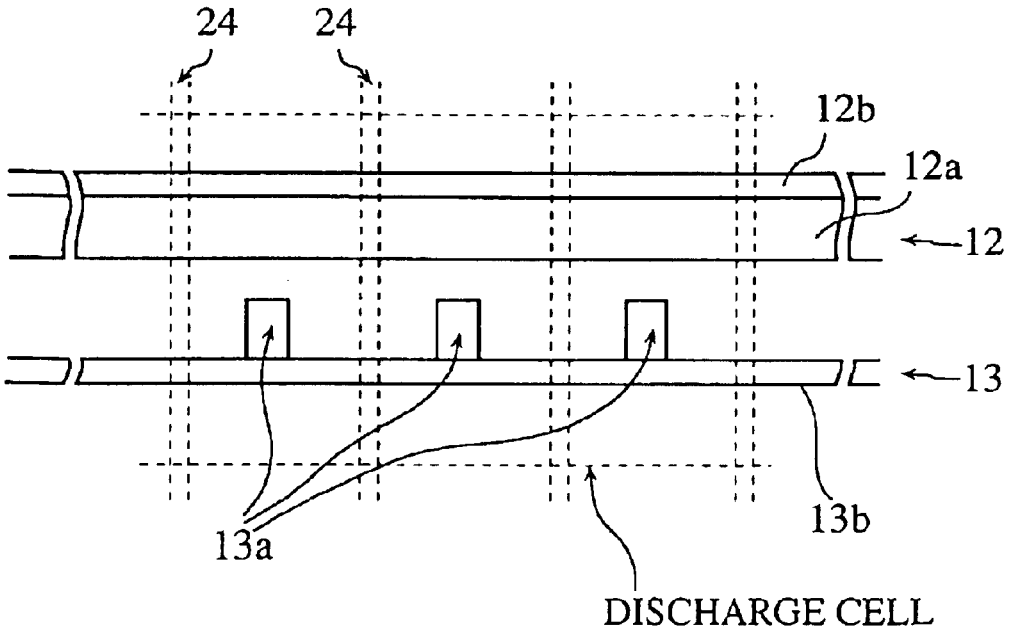
FIG. 7 is an example of asymmetric display electrodes in the PDP.

FIG. 7 depicts an example of a pair of asymmetric display electrodes to each other. It describes the front view of the front panel 10 seen from the back panel 20.

In this figure, each pair of dotted lines extending vertically identifies the position of each of the ribs 24. A frame surrounded by two adjacent horizontal dotted lines and the ribs shows one discharge cell.

FIG. 4 was an example of symmetric display electrodes, where the transparent electrodes 12*a* and 13*a*extend along the bus electrodes 12*b* and 13*b* respectively. FIG. 7, on the contrary, shows an example of asymmetric display electrodes, where either the display electrode 12 or 13 is transformed.

Such transformation of one display electrode of a pair is known to generate so-called "unequal electric field" in the sustaining discharge phase, which generates strong electric field inside each discharge cell (Discharge Handbook, Section 3, Chap.1, pp. 115, and pp.124).

Therefore, it is effective to make a pair of electrodes 12 and 13 asymmetric to each other for the purpose of generating strong electric field inside discharge cells.

Specifically, the transparent electrodes 13*a* in the sustaining electrode 13 are placed in "island"-like ways, each dotted along the bus electrode 13*b*. Each of this island-like transparent electrodes 13*a* protrudes from the bus electrode 13*b* against the other electrode (the scanning electrode 12), rather in a sharp-pointed form.

In this case, a distance between a pair of electrodes means a distance between the tip of the protrusion and the scanning electrode 12. When voltage is applied between the display electrodes in the sustaining discharge phase, unequal electric field is generated at the tip of the protrusion due to the concentration of static charge. This unequal electric field promotes the generation of strong electric field inside discharge cells.

A size of the protrusion made by the transparent electrode 13*a* differs by its cell pitch. Taking an example of PDPs for high-definition television of 42-inch size, a cell pitch of the width direction of the display electrodes is about 480 $\mu$m. So adequate size for protrusion by the transparent electrode 13*a* is about 150 $\mu$m. For easy production, adequate size of the protrusion is in the range of 10–50 $\mu$m, although 1 $\mu$m can still do.

Note that the display electrode 13 in FIG. 7 is a stacked display electrode, whose protrusions are made by transparent electrode 13*a*. However it is also possible to make the electrode from metal electrodes. In such cases, protrusions should be produced on the metal electrodes themselves, which will have the same effect.

Also note that each discharge cell has one protrusion in the example of FIG. 7. It is also possible to make two or more protrusions in one cell. However, one is desirable to concentrate a density of static charge, so as to improve the strength of the electric field.

Production of the PDP1

The following is an example of production method of the PDP1.

Production of the front panel 10:

First, the display electrodes 12 and 13 are formed on the surface of the front glass substrate 11 made of soda-lyme glass (with a thickness of 2 mm).

If the display electrodes 12 and 13 are stacked electrodes, an ITO sheet of a thickness of about 0.12 $\mu$m is firstly formed evenly using a sputtering method. Then, transparent electrodes 12*a* and 13*a* are created using a photolithograph method, which performs patterning of the transparent electrodes in a stripe pattern. Next, a light-sensitive silver paste is formed on the whole surface of the front glass substrate 11, and patterning is performed using the photolithograph method. Finally the silver paste is baked until 550° C. to form bus electrodes 12*b* and 13*b* on each of the transparent electrodes 12*a* and 13*a*, respectively.

Uniform electrodes could be made from either silver or Cu—Cr—Cr electrodes. For silver electrodes, a light-sensitive Ag paste is applied on the whole surface first. Then, it is patterned by a photolithograph method, to finally form silver electrodes. Cu—Cr—Cr electrodes, on the other hand, first use a sputtering method in applying a Cu layer, a Cr layer, and a Cr layer in this order to the whole surface, and then a lithograph method for patterning these layers to finally form Cu—Cr—Cr electrodes.

After forming electrodes, dielectric layer 14 is to be formed. The following is a description of the making of the dielectric layer where dielectric layer is a single layer.

First, a paste for dicoating or for printing purpose is produced by mixing dielectric glass powders (55–70 weight %) of 600° C. or less softening temperature and a binder (30–45 weight %) with a three roll. The binder composes either cellulose or acrylic resin, and solvent of either terpineol or butyl carbitol acetate (1–20 weight % of the total binder).

The dielectric glass powder is obtained from pulverizing dielectric glass material. It is preferable to use a wet jet mill (from Nanomizer) and pulverize it until the average diameter of the particle becomes 0.1–1.5 $\mu$m, and the maximum diameter of the particle becomes 3 times as big as the average diameter or less, in order to form a dielectric layer of a quality. The above conditions help prevent the generation of air-bubbles in the baking phase, which helps form a uniform electric characteristic of the dielectric layer 14, and thus prevent electric breakdowns in driving the PDP.

If is preferable to add 0.1–0.4 weight % of plasticizer to the paste for facilitating painting. Possible candidates for the plasticizer are as follows: Dioctyl phthalate, dibutyl phthalate, triphenyl phosphate, tri-n-butyl phosphate or dispersion, glycerol monooleate, sorbitol sesquiolate, homogenol (product name by Kao Corporation), and alkyl aryl phosphoric ester. The resultant paste is applied on the front glass substrate 11 either by a dicoating method or by a screen-printing method. After drying the above, it is baked at a little higher temperature than the softening temperature mentioned above, to finally form the dielectric layer 14.

The use of ZnO glass as dielectric glass material is effective for keeping a permittivity of the dielectric layer 14 small as 6–11. ZnO glass has a small permittivity as about 7, compared to conventionally used PbO glass that has a permittivity of about 10–12.

When the dielectric layer 14 is a two-layer structure, which is made of the first dielectric layer 14*a* and the second dielectric layer 14*b*, the making is basically the same as the single layer stated above; after forming the first dielectric layer 14*a*, the second dielectric layer 14*b* should be formed using the same method as above.

One thing has to be noted in the selection of glass material for a two-layer dielectric structure. That is, the softening temperature of glass material of the second dielectric layer 14*b* should be lower than that of the first dielectric layer 14*a*, so that it is possible to bake the second dielectric layer-14*b* in a lower temperature than the first dielectric layer 14*a*; glass material for the two layers should be selected as such.

Two Examples of dielectric glass material for the first dielectric layer 14*a* are: PbO glass with 550–575° C. softening temperature, a permittivity of 9–11, PbO—$B_2O_3$—$SiO_2$—$Al_2O_3$ as a main component, and ZnO glass with 550–575° C. softening temperature, a permittivity of 6–7, and ZnO—$B_2O_3$—$SiO_2$—$K_2O$—CuO as a main component.

Two Examples of dielectric glass material for the second dielectric layer 14*b* are; PbO glass with 440–475° C. softening temperature, a permittivity of 9–13, PbO—$B_2O_3$—$SiO_2$—CaO as a main component, and ZnO glass with 450–480° C. softening temperature, a permittivity of 6–7, and ZnO—$B_2O_3$—$SiO_2$—$K_2O$ as a main component.

For a two-layer structure, a permittivity for the whole layer is kept low if dielectric glass material for one layer has a low permittivity, even if material for the other layer has higher constant; for example, if one layer has a permittivity of 7, and the other layer has 11–13, then a constant for the dielectric layer 14, as a whole, will be kept low such as less than 11.

The next step is to form a protective layer 15, which is to be formed made of MgO, on the dielectric layer. The protective layer 15 can be formed using such method as a vacuum evaporation method, a sputtering method, and a CVD method (whether a heating CVD method or a plasma CVD method), with a thickness of 1.0 μm for example. Using the CVD method, it is possible to form MgO layer facing toward the (100) surface or toward (110) surface.

Production of the back panel 20:

First, address electrodes 22 are formed on the back glass substrate 21 (a thickness of 2 mm). Specifically, they are formed first by painting an Ag paste in stripes with predetermined intervals using a screen-printing method, then by baking.

Next, dielectric layer 23 is formed on the whole surface of the back glass substrate 21 where there formed the address electrodes 22.

The dielectric layer 23 can be formed in the same way as the dielectric layer 14 of the front panel. Here is an example how to make the dielectric layer 14. First, weight 20% TiO2(average diameter of particle is in the range of 0.1–0.5 μm) is mixed with glass powder (average diameter of particle is 0.1–3.5 μm), so as to make a dielectric glass paste. This dielectric glass paste is then applied in 20–30 μm thickness and then baked in 540–580° C., to finally make the dielectric layer 14.

Next step is to form the ribs 24 by applying glass material between each adjacent address electrodes 22 on the dielectric layer 23. The ribs 24 are formed by being subject to baking after the repetition of a screen-printing process.

Next step is to form the phosphor layers 25 between each of the adjacent ribs 24.

First, phosphor ink that contains either red(R), green(G), or blue(B) phosphors is applied in each gap created by the ribs 24. Then, the area is subject to drying and baking processes, to finally make the phosphor layers 25.

For applying phosphor ink, a screen-printing method could be used. For high-definition panel structures, however, it is preferable to use a method in which a fine nozzle applies phosphor ink while it is running. This method enables applying of phosphor ink evenly in each gap, even for panels with high-definition structures. In such a case, it is preferable to use phosphor powder whose particle has average size of about 3 μm for each phosphor color.

Cementing the two panels together:

The front panel 10 and the back panel 20 are then cemented together at the edge using cementing glass.

Next, inside panels is vacuumed until it becomes about ($1*10^{-4}$ Pa), and then discharge gas is filled at predetermined pressure.

This is the end of every step for making the PDP1. However, it is possible, although optional, to apply cementing glass at the tip of the ribs 24. This process bonds the two panels more firmly, thereby strengthens structure of the PDP1.

Application to a Counter-discharge PDP

So far, the description was confined to a surface-discharge PDP. However, this invention is also applicable to a counter-discharge PDP.

In the counter-discharge PDP, a pair of display electrodes is provided on both the front panel and the back panel so that each electrode of a pair is placed on the front and on the back panel respectively. In addition, the pair of display electrodes is placed at a right angle to each other, with the discharge space in-between. However, this counter-discharge PDP is the same as the surface-PDP, in that each display electrode is covered by a dielectric layer and that both display electrodes are facing the discharge space with a dielectric layer in-between.

In this counter-discharge PDP, it is also possible to enhance luminance and luminous efficiency, if the panel structure is properly set to generate an equivalent electric field strength of 37V/cm·KPa or more in the discharge space in the sustaining discharge period. The conditions for the panel structure are the same as the surface-discharge PDP1 (i.e. a distance between the display electrodes, a thickness and a permittivity of the dielectric layer, and an amount of Xe in the discharge gas and pressure at which the gas is filled).

Embodiment Examples

Based on the best mode, 20 embodiment examples of surface-discharge type PDPs are produced with the following conditions described in Table 1 and 2.

Note that, in every example, $BaMgAl_{10}O_{17}:Eu^{2+}$ is used as a blue phosphor.

Either Ne—Xe, Ne—Xe—Ar, or Ne—Xe—Ar—He is used as a type of discharge gas. Pressure by Xe in the total discharge gas is in the range of 5–90%, and pressure at which the discharge gas is filled is set in the range of 66.5–200 KPa, as Table 1 and 2 shows.

TABLE 1

| NO. | STRUCTURE/ THICKNESS OF DIELECTRIC | DIELECTRIC CONSTANT 1st-LAYER | DIELECTRIC CONSTANT 2nd-LAYER | DIELECTRIC THICKNESS ON THE TIP OF ELECTRODES | GAP BE-TWEEN ELEC-TRODES | FORM OF ELEC-TRODES | TYPE/ PRESSURE OF GAS | EQUIV. FIELD STRGTH. | ULTRA-VIOLET WAVE-LENGTH | LUMI-NANCE (cd/m²) | CHANGE IN LUMINANCE AFTER 24 HRS |
|---|---|---|---|---|---|---|---|---|---|---|---|
| 1 | 1 LAYER 15 μm | 9 | — | 15 μm | 60 μm | PAR-ALLEL | Ne-Xe (90:10), 66.5 KPa | 43 V/ cm · KPa | 173 nm | 890 | −5.0% |
| 2 | 1 LAYER 15 μm | 6.7 | — | 15 μm | 60 μm | 1 SIDE PROTRU-SION | Ne-Xe (90:10), 66.5 KPa | 75 V/ cm · KPa | 173 nm | 920 | −4.0% |

TABLE 1-continued

| NO. | STRUCTURE/ THICKNESS OF DIELECTRIC | DIELECTRIC CONSTANT 1st-LAYER | DIELECTRIC CONSTANT 2nd-LAYER | DIELECTRIC THICKNESS ON THE TIP OF ELECTRODES | GAP BE-TWEEN ELEC-TRODES | FORM OF ELEC-TRODES | TYPE/ PRESSURE OF GAS | EQUIV. FIELD STRGTH. | ULTRA-VIOLET WAVE-LENGTH | LUMI-NANCE (cd/m$^2$) | CHANGE IN LUMINANCE AFTER 24 HRS |
|---|---|---|---|---|---|---|---|---|---|---|---|
| 3 | 2 LAYERS 15 μm | 7.0 | 6.7 | 5 μm | 60 μm | 1 SIDE PROTRU-SION | Ne-Xe (90:10), 66.5 KPa | 100 V/ cm · KPa | 173 nm | 910 | −3.5% |
| 4 | 2 LAYERS 15 μm | 6.5 | 6.0 | 5 μm | 50 μm | 1 SIDE PROTRU-SION | Ne-Xe—Ar (91:8:1), 79.8 KPa | 113 V/ cm · KPa | 173 nm | 980 | −3.2% |
| 5 | 2 LAYERS 20 μm | 11 | 6.2 | 3 μm | 30 μm | PAR-ALLEL | Ne-Xe—Ar (91:8:1), 79.8 KPa | 83 V/ cm · KPa | 173 nm | 950 | −3.8% |
| 6 | 1 LAYER 10 μm | 9 | — | 10 μm | 50 μm | 1 SIDE PROTRU-SION | Ne-Xe (94:6), 86 KPa | 82 V/ cm · KPa | 173 nm | 915 | −4.2% |
| 7 | 2 LAYERS 25 μm | 11 | 6.7 | 5 μm | 20 μm | 1 SIDE PROTRU-SION | Ne-Xe—Ar—He (83:6:1:10), 79.8 KPa | 150 V/ cm · KPa | 173 nm | 995 | −2.9% |
| 8 | 1 LAYER 25 μm | 9 | — | 25 μm | 70 μm | PAR-ALLEL | Ne-Xe (95:5), 66.5 KPa | 37 V/ cm · KPa | 173 nm | 785 | −5.6% |
| 9 | 1 LAYER 15 μm | 6.5 | — | 15 μm | 70 μm | 1 SIDE PROTRU-SION | Ne-Xe (80:20), 106 KPa | 60 V/ cm · KPa | 173 nm | 920 | −4.0% |
| 10 | 1 LAYER 15 μm | 9.0 | — | 15 μm | 60 μm | 1 SIDE PROTRU-SION | Ne-Xe (70:30), 86 KPa | 75 V/ cm · KPa | 173 nm | 1050 | −3.5% |
| 11 | 2 LAYERS 15 μm | 11 | 6.5 | 5 μm | 60 μm | 1 SIDE PROTRU-SION | Ne-Xe (50:50), 66.5 KPa | 42 V/ cm · KPa | 173 nm | 1150 | −3.4% |
| 12 | 2 LAYERS 15 μm | 6.5 | 11 | 5 μm | 60 μm | 1 SIDE PROTRU-SION | Ne-Xe (30:70), 66.5 KPa | 113 V/ cm · KPa | 173 nm | 1200 | −2.5% |

TABLE 2

| NO. | STRUCTURE/ THICKNESS OF DIELECTRIC | DIELECTRIC CONSTANT 1st-LAYER | DIELECTRIC CONSTANT 2nd-LAYER | DIELECTRIC THICKNESS ON THE TIP OF ELECTRODES | GAP BE-TWEEN ELEC-TRODES | FORM OF ELEC-TRODES | TYPE/ PRESSURE OF GAS | EQUIV. FIELD STRGTH. | ULTRA-VIOLET WAVE-LENGTH | LUMI-NANCE (cd/m$^2$) | CHANGE IN LUMINANCE AFTER 24 HRS |
|---|---|---|---|---|---|---|---|---|---|---|---|
| 13 | 2 LAYERS 20 μm | 11 | 6.7 | 3 μm | 30 μm | 1 SIDE PROTRU-SION | Ne-Xe (20:80), 79.8 KPa | 135 V/ cm · KPa | 173 nm | 1350 | −3.0% |
| 14 | 1 LAYER 10 μm | 6.0 | — | 10 μm | 50 μm | 1 SIDE PROTRU-SION | Ne-Xe—He (20:30:50), 79.8 KPa | 83 V/ cm · KPa | 173 nm | 1320 | −3.1% |
| 15 | 2 LAYERS 25 μm | 6.5 | 10 | 3 μm | 20 μm | 1 SIDE PROTRU-SION | Ne-Xe (10:90), 66.5 KPa | 257 V/ cm · KPa | 173 nm | 1350 | −2.9% |
| 16 | 1 LAYER 25 μm | 6.8 | — | 25 μm | 70 μm | PAR-ALLEL | Ne-Xe (85:15), 73.1 KPa | 37 V/ cm · KPa | 173 nm | 850 | −3.4% |
| 17 | 1 LAYER 25 μm | 6.8 | — | 25 μm | 90 μm | Ag, 1 SIDE PROTRU-SION | Ne-Xe (80:20), 79.8 KPa | 47 V/ cm · KPa | 173 nm | 910 | −3.2% |
| 18 | 2 LAYERS 35 μm | 10 | 6.7 | 35 μm | 70 μm | Ag, 1 SIDE PROTRU-SION | Ne-Xe (85:15), 86.4 KPa | 56 V/ cm · KPa | 173 nm | 880 | −3.0% |
| 19 | 1 LAYER 25 μm | 6.7 | — | 25 μm | 80 μm | Cr-Cu-Cr 1 SIDE PROTRU-SION | Ne-Xe (85:15), 120 KPa | 37 V/ cm · KPa | 173 nm | 1380 | −2.1% |
| 20 | 2 LAYERS 35 μm | 6.7 | 10 | 35 μm | 20 μm | Cr-Cu-Cr 1 SIDE PROTRU-SION | Ne-Xe (80:20), 200 KPa | 80 V/ cm · KPa | 173 nm | 1650 | −2.5% |

TABLE 2-continued

| NO. | STRUCTURE/ THICKNESS OF DIELECTRIC | DIELECTRIC CONSTANT 1st-LAYER | DIELECTRIC CONSTANT 2nd-LAYER | DIELECTRIC THICKNESS ON THE TIP OF ELECTRODES | GAP BE-TWEEN ELEC-TRODES | FORM OF ELEC-TRODES | TYPE/ PRESSURE OF GAS | EQUIV. FIELD STRGTH. | ULTRA-VIOLET WAVE-LENGTH | LUMI-NANCE (cd/m$^2$) | CHANGE IN LUMINANCE AFTER 24 HRS |
|---|---|---|---|---|---|---|---|---|---|---|---|
| 21* | 2 LAYERS 40 μm | 11 | 11 | 20 μm | 120 μm | PAR-ALLEL | Ne-Xe (96:4), 60 KPa | 23 V/ cm · KPa | 147 nm | 402 | −15.0% |
| 22* | 1 LAYER 40 μm | 11 | 11 | 40 μm | 100 μm | PAR-ALLEL | Ne-Xe (97:3), 53 KPa | 32 V/ cm · KPa | 147 nm | 395 | −15.4% |
| 23* | 2 LAYERS 40 μm | 11 | 11 | 20 μm | 100 μm | PAR-ALLEL | Ne-Xe (95:5), 66.5 KPa | 26 V/ cm · KPa | 147 nm | 420 | −14.5% |
| 24* | 1 LAYERS 40 μm | 11 | 11 | 40 μm | 100 μm | PAR-ALLEL | Ne-Xe (95:5), 66.5 KPa | 26 V/ cm · KPa | 147 nm | 415 | −15.8% |

The display electrodes 12 and 13 for embodiment examples 1–16 are stacked electrodes with metal electrodes situating on an ITO transparent electrode, which is not described in Table 1 or 2. Those for embodiment examples 17–20 are metal electrodes; in which example 17 has Ag electrodes, and examples 19 and 20 have Cr—Cu—Cr electrodes.

As for the forms of the display electrodes 12 and 13, "parallel" in the table means that the example has simple stripe-patterned display electrodes, and "protrusions on one side" means there are protrusions on the display electrode 13 as shown in FIG. 7.

As for the structures of the dielectric layer, the examples have either single or double layer structure (as represented as 1 layer and 2 layers in the tables). If the display electrodes are stacked display electrodes, and their dielectric layer is double layer structure, the second layer is arranged to be only on the metal display electrodes.

As for the dielectric material composing the dielectric layers, those with permittivity depicted in Table 1 and 2 are used.

Concretely, for dielectric glass with a permittivity of 9 or more, PbO glass with PbO—$B_2O_3$—$SiO_2$—$Al_2O_3$ as a main component is used; for that with a permittivity of 7 or less, ZnO glass with ZnO—$B_2O_3$—$SiO_2$—$K_2O$ as a main component is used.

Thickness of the dielectric layers are in the range of 3–25 μm (corresponding to "dielectric thickness on the tip of electrodes" in Table 1 and 2). Note that "thickness of dielectric" for double layer signifies a thickness where the first and second layers are overlapping. Therefore, for stacked display electrodes with double dielectric layer structure, "thickness of dielectric" is larger than "dielectric thickness on the tip of electrodes" in value.

In addition, surface-discharge type examples 21–24 in Table 2 are created for the purpose of comparison.

These comparison examples are structured mostly the same as the embodiment examples except that the thickness of the dielectric is set to be 30 μm or more, and the permittivity of the dielectric is set to be 11, the distance of the display electrodes (i.e. transparent electrodes) are set to be 80 μm or more, and the discharge gas is Ne—Xe (amount of Xe is set to be 3–5% of the total capacity).

Tests for Qualities

Using both the embodiment examples and the comparison examples as constructed above, several tests were conducted as for the following: an equivalent electric field strength in the discharge space, wavelength of ultraviolet light, panel luminance, and change rate in panel luminance (i.e. accelerated life testing).

The tests for equivalent electric field strength in the discharge space, ultraviolet light wavelength, and panel luminance were conducted by driving each PDP by discharge voltage of 180 V, and frequency of 30 kHz.

The equivalent electric field strength in the discharge space is obtained using the expression 1 stated earlier; specifically, it is obtained by simulation of the discharge space in 3-D, taking into consideration variety of parameters.

The change rate in panel luminance is obtained in a more severe condition than the usual driving condition (i.e. discharge voltage of 200 V, and frequency of 50 kHz) for 24 hours; specifically it is a difference in panel luminance before and after the driving of a PDP. Five samples were prepared for each examples and the average is taken among them.

Test Results and Considerations

Based on the test results shown on Table 1 and 2, the following were considered.

In the embodiment examples 1–20, electric field strength of 37V/cm·Kpa or more and a main ultraviolet wavelength of 173 nm (a Xe excimer wavelength) are both observed. On the other hand, in the comparison examples 21–24, the observed electric field strength is less than 37V/cm·KPa, and the observed ultraviolet wavelength is mainly 147 nm (a Xe resonance line).

It is worth mentioning that the embodiment examples of 1–20 achieve 2 to 3 times as much panel luminance as the comparison examples 21–24 or even more.

This implies that if electric field strength of 37 V/cm·Kpa or more is achieved in the discharge space, amount of Xe excimer in the ultraviolet light will increase, and the panel luminance will be greatly enhanced.

Also note that change rate in panel luminance for the embodiment examples 1–20 are ⅓ to ⅕ of the comparison examples 21–24, which signifies superior endurance for PDPs of the embodiment examples. One possible reason for this high endurance of the embodiment examples is the higher wavelength of the Xe excimer, compared to the Xe resonance line. This reduces energy in the collision between ultraviolet lights and phosphors, thereby reduces damages for the phosphors.

Other reasons can be considered as follows:

The embodiment examples 1–20 have larger amount of Xe in the discharge space and higher panel luminance, compared to the comparison examples 21–24. Also in the examples 9–20, those with larger amount of Xe in the discharge gas tend to have higher panel luminance. Also those with higher pressure at which the gas is filled, have higher panel luminance if the ratio of Xe in the discharge gas is the same.

Therefore, it is summarized that larger the amount of Xe in the discharge space, it tends to achieve higher panel luminance. This is probably because the larger the amount of Xe, the more Xe excimer are to be generated.

Comparing the embodiment example 8 and the comparison example 24, they share the same condition in that a ratio of Xe in the discharge gas is 5%, and filling pressure is 66.5 KPa. However they differ in equivalent electric field strength; the embodiment example 8 has high equivalent electric field of 37V/cm·KPa, and the comparison example 24 has lower one of 26V/cm·Kpa.

This implies that not only an amount of Xe in the discharge gas, but a thickness and a permittivity of the dielectric layer, and other conditions as a gap between the display electrodes also affect the equivalent electric field strength. The embodiment examples of 1,2,6,8–10,14,16,17, 19, and the comparison examples of 22, 24 have a single dielectric layer structure. Among them, it is observed a correlation between smaller thickness of dielectric layer and larger equivalent electric field strength.

The embodiment examples of 3–5, 7, 11–13, 15, 18, 20, and the comparison examples of 21, 23 have a double dielectric layer structure. Among them, it is observed a correlation between smaller thickness of dielectric layer at the end of the electrodes and larger equivalent electric field strength.

Among the embodiment examples 1–20, there is a correlation between smaller distance between the display electrodes and higher equivalent field strength in the discharge space.

These implies that smaller the thickness of dielectric layer, and smaller the distance between the display electrodes, it tends to achieve higher equivalent field strength in the discharge space.

Among the embodiment examples 1–20, it is observed that non-parallel display electrodes with protrusions on one electrode tend to achieve stronger equivalent electric field and higher panel luminance, than parallel ones without protrusions.

This implies that asymmetrical display electrodes tend to achieve stronger equivalent electric field than symmetrical ones.

Industrial Applicability

The PDP in the present invention is applicable to display apparatuses for computers and televisions. In particular, it is suitable for apparatuses for displaying large and high-definition screens.

What is claimed is:

1. An alternating current type surface-discharge plasma display panel comprising a facing pair of substrates and a plurality of ribs interposed between the substrates so as to form a plurality of spaces, the plurality of spaces being provided with a phosphor layer and filled with discharge gas, so as to form a plurality of discharge spaces;

inside each of the discharge spaces, plural pairs of display electrodes covered by a dielectric layer being provided, the dielectric layer is made of two different sets of material, the plasma display panel performing displaying by the following steps: 1) writing by an accumulation of electric charge in the dielectric layer, 2) applying a predetermined sustaining voltage between the pairs of display electrodes, 3) glow-discharging in selected discharge spaces in which the electric charge has been accumulated in the dielectric layer, and 4) converting ultraviolet light resulting from the glow-discharge into visible light by means of the phosphor layer, wherein the dielectric layer is made by laminating the two different dielectric materials, and wherein the panel structure is set such that an equivalent electric field strength of 37 V/cm·Pa or more is generated in the selected discharge spaces, when the predetermined sustaining voltage is applied.

2. The plasma display panel of claim 1, wherein the discharge gas contains xenon, and the ultraviolet light contains more amount of xenon molecular line than an amount of xenon resonance) line on the spectrum.

3. A display unit comprising the alternating current type surface-discharge plasma display panel of claim 2, and a driving circuit for applying voltage to each electrode included in the plasma display panel.

4. A display unit comprising the alternating current type surface-discharge plasma display panel of claim 1, and a driving circuit for applying voltage to every electrode included in the plasma display panel.

5. An alternating current type surface-discharge plasma display panel comprising a facing pair of substrates and a plurality of ribs interposed between the substrates so as to form a plurality of spaces, the plurality of spaces being provided with a phosphor layer and filled with discharge gas, so as to form a plurality of discharge spaces, inside each of the discharge spaces, plural pairs of display electrodes are covered by a dielectric layer, the dielectric layer is made of two different sets of material, the plasma display panel performing displaying by the following steps: 1) writing by an accumulation of electric charge in the dielectric layer, 2) applying a predetermined sustaining voltage between the pairs of display electrodes, 3) glow-discharging in selected discharge spaces in which the electric charge has been accumulated in the dielectric layer, and 4) converting ultraviolet light resulting from the glow-discharge into visible light by means of the phosphor layer, wherein an amount of xenon contained in the discharge gas and filling pressure of the discharge gas, a gap between the display electrodes, and a thickness and a permittivity of the dielectric layer are set so that an equivalent electric field strength of 37V/cm·Pa or more is generated in the selected discharge spaces, when the predetermined sustaining voltage is applied.

6. The plasma display panel of claim 5, wherein xenon contained in the discharge gas is in a range of 5% to 90% inclusive.

7. The plasma display panel of claim 6, wherein the distance between the pairs of display electrodes is in a range of 20 $\mu$m to 90 $\mu$m inclusive, where the display electrodes are facing the discharge spaces.

8. The plasma display panel of claim 6, wherein the filling pressure of the discharge gas is in a range of 66.5 KPa to 200 KPa inclusive.

9. The plasma display panel of claim 8, wherein the distance between the pairs of display electrodes is in a range of 20 μm to 90 μm inclusive, where the display electrodes are facing the discharge spaces.

10. The plasma display panel of claim 5, wherein the thickness of the dielectric layer is in a range of 3 μm to 5 μm inclusive, at a point where the pair of the display electrodes are opposing each other.

11. The plasma display panel of claim 10, wherein the dielectric constant of the dielectric layer is 6 or more and less than 9.

12. The plasma display panel of claim 11, wherein the distance between the pairs of display electrodes is in a range of 20 μm to 90 μm inclusive, where the display electrodes are facing the discharge spaces.

13. The plasma display panel of claim 10, wherein the distance between the pairs of display electrodes is in a range of 20 μm to 90 μm inclusive, where the display electrodes are facing the discharge spaces.

14. The plasma display panel of claim 5, wherein the distance between the pairs of display electrodes is in a range of 20 μm to 90 μm inclusive, where the display electrodes are facing the discharge spaces.

15. A display unit comprising the alternating current type surface-discharge plasma display panel of claim 5, and a driving circuit for applying voltage to each electrode included in the plasma display panel.

16. An alternating current type surface-discharge plasma display panel comprising a first plate and a second plate disposed parallel to each other, with a plurality of ribs interposed between the two plates so as to form a plurality of spaces, the first plate having, on an inner surface, plural pairs of display electrodes covered by a dielectric layer, the dielectric layer is made of two different sets of material, the second plate having, on an inner surface, a plurality of address electrodes, the first plate and the second plate being disposed in such a manner that the display electrodes cross over the address electrodes, each of the plurality of ribs being interposed between adjacent address electrodes, and each of the plurality of spaces being provided with a phosphor layer and filled with discharge gas, so as to form discharge spaces, the plasma display panel performing displaying the following steps: 1) accumulating electric charge in the dielectric layer by performing writing-discharge between the display electrodes and the address electrodes, 2) applying a predetermined sustaining voltage between the pairs of display electrodes, 3) glow-discharging in selected discharge spaces in which the electric charge has been accumulated in the dielectric layer, and 4) converting ultraviolet light resulting from the glow-discharge into visible light by means of the phosphor layer, wherein the panel structure is set such that an equivalent electric field strength of 37V/cm·Pa or more is generated in the selected discharge spaces, when the predetermined sustaining voltage is applied.

17. A display unit comprising the alternating current type surface-discharge plasma display panel of claim 16, and a driving circuit for applying voltage to each electrode included in the plasma display panel.

18. An alternating current type surface-discharge plasma display panel comprising a first plate and a second plate disposed parallel to each other, with a plurality of ribs interposed between the two plates so as to form a plurality of spaces, the first plate having, on an inner surface, plural pairs of display electrodes covered by a dielectric layer, the dielectric layer is made of two different sets of material, the second plate having, on an inner surface, a plurality of address electrodes, the first plate and the second plate being disposed in such a manner that the display electrodes cross over the address electrodes, each of the plurality of ribs being interposed between adjacent address electrodes, and each of the plurality of spaces being provided with a phosphor layer and filled with discharge gas, so as to form discharge spaces, the plasma display panel performing displaying by the following steps: 1) accumulating electric charge in the dielectric layer by performing writing-discharge between the display electrodes and the address electrodes, 2) applying a predetermined sustaining voltage between the pairs of display electrodes, 3) glow-discharging in selected discharge spaces in which the electric charge has been accumulated in the dielectric layer, and 4) converting ultraviolet light resulting from the glow-discharge into visible light by means of the phosphor layer, wherein an amount of xenon contained in the discharge gas and filling pressure of the discharge gas, a gap between the display electrodes, and the thickness and a permittivity of the dielectric layer are set so that an equivalent electric field strength of 37V/cm·Pa or more is generated in the selected discharge spaces, when the predetermined sustaining voltage is applied.

19. The plasma display panel of claim 18, wherein the distance between the pair of display electrodes is in a range of 20 μm to 90 μm inclusive, where the display electrodes are facing the discharge spaces.

20. The plasma display panel of claim 19, wherein forms of a pair of the display electrodes differ from each other.

21. The plasma display panel of claim 19, wherein at least one of pair of the display electrodes has protrusions extending toward the other display electrode.

22. The plasma display panel of claim 19, wherein the display electrodes are metal electrodes and the dielectric constant of the dielectric layer is 6 or more than 9 or less.

23. The plasma display panel of claim 19, wherein the display electrodes are made by stacking bus lines on transparent electrodes, and the dielectric layer is thicker on the bus lines than on the transparent electrodes.

24. A display unit comprising the alternating current type surface-discharge plasma display panel of claim 18, and a driving circuit for applying voltage to each electrode included in the plasma display panel.

25. An alternating current type surface-discharge plasma display panel comprising a facing pair of substrates and a plurality of ribs interposed between the substrates so as to form a plurality of spaces, the plurality of spaces being provided with a phosphor layer and filled with discharge gas including Xenon, so as to form a plurality of discharge spaces;

inside each of the discharge spaces, plural pairs of display electrodes are covered by a dielectric layer;

the plasma display panel providing a display by: 1) writing by an accumulation of electric charge in the dielectric layer, 2) applying a predetermined sustaining voltage between the pairs of display electrodes, 3) glow-discharging in selected discharge spaces in which the electric charge has been accumulated in the dielectric layer, and 4) converting ultraviolet light resulting from the glow-discharge into visible light by means of the phosphor layer, wherein the dielectric layer is made by laminating at least two different dielectric materials, and wherein a ratio of Xe excimer exceeds that of a Xe resonance line in the ultraviolet light when a predetermined sustaining voltage is applied.

26. The alternating current type surface-discharge plasma display panel of claim 25 wherein a first dielectric material covers the display electrodes and a second dielectric material covers only a portion of the display electrodes.

27. The alternating current type surface-discharge plasma display panel of claim 25 wherein a first dielectric material is $ZnO—B_2O_3—SO_2—K_2O—CuO$ and a second dielectric material is $ZnO—B_2O_3—SiO_2—K_2O$.

28. The alternating current type surface-discharge plasma display panel of claim 25 wherein one dielectric material has a dielectric constant within a range of 6–7 and the other dielectric material has a dielectric constant within a range of 11–13.

29. The alternating current type surface-discharge plasma panel of claim 25 wherein one dielectric material is a PbO glass and the other dielectric material is a ZnO glass.

30. The alternating current type surface-discharge plasma panel of claim 25 wherein one dielectric material has a higher softening temperature than the other dielectric material.

* * * * *